US007313928B2

(12) United States Patent
Girard

(10) Patent No.: US 7,313,928 B2
(45) Date of Patent: Jan. 1, 2008

(54) INSERT FOR COOLER

(76) Inventor: Lucien Girard, 48 boul. Tadoussac, St-Fulgence, QBC (CA) G0V 1S0

( * ) Notice: Subject to any disclaimer, the term of this patent is extended or adjusted under 35 U.S.C. 154(b) by 248 days.

(21) Appl. No.: 11/181,931

(22) Filed: Jul. 15, 2005

(65) Prior Publication Data

US 2007/0012069 A1 Jan. 18, 2007

(51) Int. Cl.
*F25D 3/02* (2006.01)

(52) U.S. Cl. ..... 62/459; 62/457.7

(58) Field of Classification Search ..... 62/457.7, 62/459, 457.1, 371
See application file for complete search history.

(56) References Cited

U.S. PATENT DOCUMENTS 2,663,157 A * 12/1953 Laramy ..... 62/329
4,424,687 A 1/1984 Morgan
4,765,151 A 8/1988 Bessey
5,052,184 A * 10/1991 Jarvis ..... 62/60
5,636,524 A 6/1997 Woods et al.
D448,249 S 9/2001 DeCastro et al.
6,405,557 B1 6/2002 DeCastro et al.
6,574,983 B2 6/2003 Smith et al.
6,763,959 B2 7/2004 Tedder
2005/0072181 A1* 4/2005 Mogil et al. ..... 62/457.7

* cited by examiner

*Primary Examiner*—Melvin Jones
(74) *Attorney, Agent, or Firm*—Equinox Protection; Franz Bonsang, Patent Agent

(57) ABSTRACT

An insert for a cooler is sized and shaped for placement on a lower surface of the cooler while supporting foodstuffs placed on insert. Draining apertures on insert allow liquid to drain away from foodstuffs into a space below insert and thereby separates liquid from foodstuffs. Draining apertures are formed from internal walls having curved sections and are sized to facilitate insertion of human fingers therein during cleaning, the curved sections and size of apertures facilitating cleaning. Guide lines marked on insert allow insert to be cut to be adapted in size and shape to lower surface of cooler.

13 Claims, 5 Drawing Sheets

INSERT FOR COOLER

FIELD OF THE INVENTION

The present invention relates to inserts for coolers and is more particularly concerned with an insert for placement on a lower surface of the interior of a cooler for foodstuffs.

BACKGROUND OF THE INVENTION

It is well known in the art to place inserts into coolers for foodstuffs for providing drainage of liquid away from foodstuffs placed therein. Such inserts, which are often removable, are typically placed with a first, bottom surface thereof situated on or near a lower surface of the interior of the cooler in which the foodstuffs are placed. The foodstuffs usually rest or are placed on a second, top surface of the insert along with a coolant, typically a frozen liquid, such as water frozen into ice. The coolant cools the foodstuffs by absorbing heat therefrom and maintains them in a cool state. However, when the coolant is a frozen liquid, such as water frozen into ice, the coolant is liquefied, i.e. melted into a liquid state, as it absorbs the heat from the foodstuffs. The liquid, i.e. coolant melted into liquid state, then drains, drawn by gravitational force, towards the lower surface of the cooler and passes through draining apertures in the insert into a space between the first, bottom surface of the insert and the lower surface of the interior of the cooler. In addition, the draining apertures of insert also provide drainage of liquids other than melted coolant, for example liquid that accidentally escapes from containers in the cooler or liquid formed by condensation during cooling of foodstuffs. This draining of liquid into the space below the insert separates the liquid from the foodstuffs and impedes substantial impregnation of the foodstuffs by the liquid which may cause, among other things, undesirable changes in texture or flavor of the foodstuffs. For some inserts, the coolant is placed in the space between the lower surface of the interior and the first, bottom surface of the insert, thus completely separating the coolant, whether in liquid or solid form, from the foodstuffs. The draining apertures permit heat to be absorbed from foodstuffs by the coolant to provide cooling of the foodstuffs while nonetheless allowing drainage of other liquids into space as described above.

For example, U.S. Pat. No. 5,636,524 issued to Woods et al. on Jun. 10, 1997, discloses an insert shaped as an inverted shallow basket with a plurality of openings as draining apertures through which liquid, i.e. water, and air may easily pass. The insert, when placed into a cooler, separates the foodstuffs and coolant, i.e. water frozen into ice, away from liquid, i.e. ice melted into water, which flows through the draining apertures into the space below the insert. The insert thereby prevents contamination of the foodstuffs from contamination by liquid. Disadvantageously, however, the draining apertures are, as shown in the drawings, formed in the shape of squares having internal sharp corners. Such sharp corners tend to accumulate dirt and are difficult to clean manually. In addition, as the insert is intended to snugly engage the cooler walls of the interior or be placed on legs therein for support in the cooler, a user will have to exercise caution to ensure the right size of insert is purchased for use in the cooler. Further, should a user purchase such an insert for a cooler and then replace the cooler with a smaller cooler, the insert may, depending on its size relative to the new, smaller cooler, be unusable therewith.

U.S. Pat. No. 6,574,983 issued to Smith et al. on Jun. 10, 2003 teaches a cooler having inserts, i.e. trays, fixedly attached to the interior. A lower insert has (draining) apertures thereon and defines a space between the lower surface of the interior and the portion of the interior in which foodstuffs are stored. Coolant can be placed with the foodstuffs above the insert or be completely separated therefrom by placement below the lower insert. Cool air from the coolant, when situated within the space below the insert, flows upwardly through draining apertures to cool foodstuffs. In turn, liquid formed by melting of coolant or liquid otherwise released in the portion where foodstuffs are placed, drains through draining apertures into space below insert. Unfortunately, the draining apertures, as shown in the drawings, also have sharp internal corners, and thus the insert suffers from the same drawbacks for cleaning as those described above for the insert disclosed in U.S. Pat. No. 5,636,524. In addition, since the insert taught by U.S. Pat. No. 6,574,983 is hingedly mounted in the cooler, it may not be easily removable, which will further complicate cleaning thereof. The use of hinges for mounting the insert also signifies that an insert, as taught in the reference, installed in a larger cooler may not be easily adaptable for use in a smaller cooler.

U.S. Pat. No. 6,405,557 issued to DeCastro et al. on Jun. 18, 2002 describes an insert having a first, bottom surface and a second, top surface. The first surface has a plurality of draining apertures which extend through insert to second surface upon which foodstuffs and coolant are placed. A side perimeter extending downwardly away from second surface supports insert on lower surface of interior of cooler for creating space between lower surface and second surface. Liquid from the portion of cooler where foodstuffs and coolant are placed flows through draining apertures into space. The draining apertures, as shown, are circular, without sharp internal corners, which facilitates somewhat their cleaning. However, when cleaning the insert manually, it may nevertheless be difficult to engage a human finger in a partially bent position therein, possibly with a cleaning instrument on the finger, to clean the interior walls forming the draining apertures. In addition, the use of circular shapes for the draining apertures requires more draining apertures, and thus more effort for cleaning, than would more elongate shapes. Further, the side perimeter may provide insufficient support for foodstuffs placed on the center of the insert and may cause the insert to sag or break, possibly exposing the foodstuffs to the liquid in the space thereunder. An optional support grill disclosed in the reference may circumvent this issue, but the grill is set out in a matrix like format which introduces a large additional amount of surfaces-which must be cleaned, thus making cleaning of the insert, especially manually, more difficult. Also, the insert is designed to be of fixed dimension. Thus, an insert purchased for a larger cooler cannot necessarily be adapted for use in a smaller cooler.

Accordingly, there is a need for an improved insert that provides facilitated cleaning and greater adaptability of size for use with coolers of different sizes.

SUMMARY OF THE INVENTION

It is therefore a general object of the present invention to provide an improved insert for separating foodstuffs from liquid in the interior of a cooler for maintaining foodstuffs placed therein in a cool state.

An advantage of the present invention is that cleaning of the insert is facilitated.

Another advantage of the present invention is that the size of the insert can be adapted for fitting the insert to a variety of sizes of cooler.

According to a first aspect of the present inventIon, there is provided an Insert for placement on a lower surface of an interior portion of a cooler for maintaining foodstuffs therein in a cool state, the lower surface being bounded by at least one cooler wall extending therefrom. The insert comprises:

a first surface having at least one leg extending vertically therefrom for supporting the insert upon the lower surface and defining a space therebetween;

a second surface, generally opposed to the first surface and upon which the foodstuffs rest when placed in the cooler; and at least one elongated curved draining aperture extending through said insert for drainage of liquid in the cooler away from the foodstuffs and into said space, each said draIning aperture being defined by at least one elongate internal wall having at least one curved section, said draining aperture being sized and adapted for cleaning of said wall by insertion therein of a human finger and scrubbing said wail therewith, said curved section facilitating said scrubbing and thereby said cleaning; and at least one guide line disposed on at least one of the first and second surface, the guide line approximately representig a surface size and a surface shape of the lower surface for facilitating cutting of the insert by a user to substantially approximately the surface size and the surface shape for adapting the insert for placement upon the lower surface.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiment of the present invention will be herein described for indicative purpose and by no means as of limitation.

Figure 1:
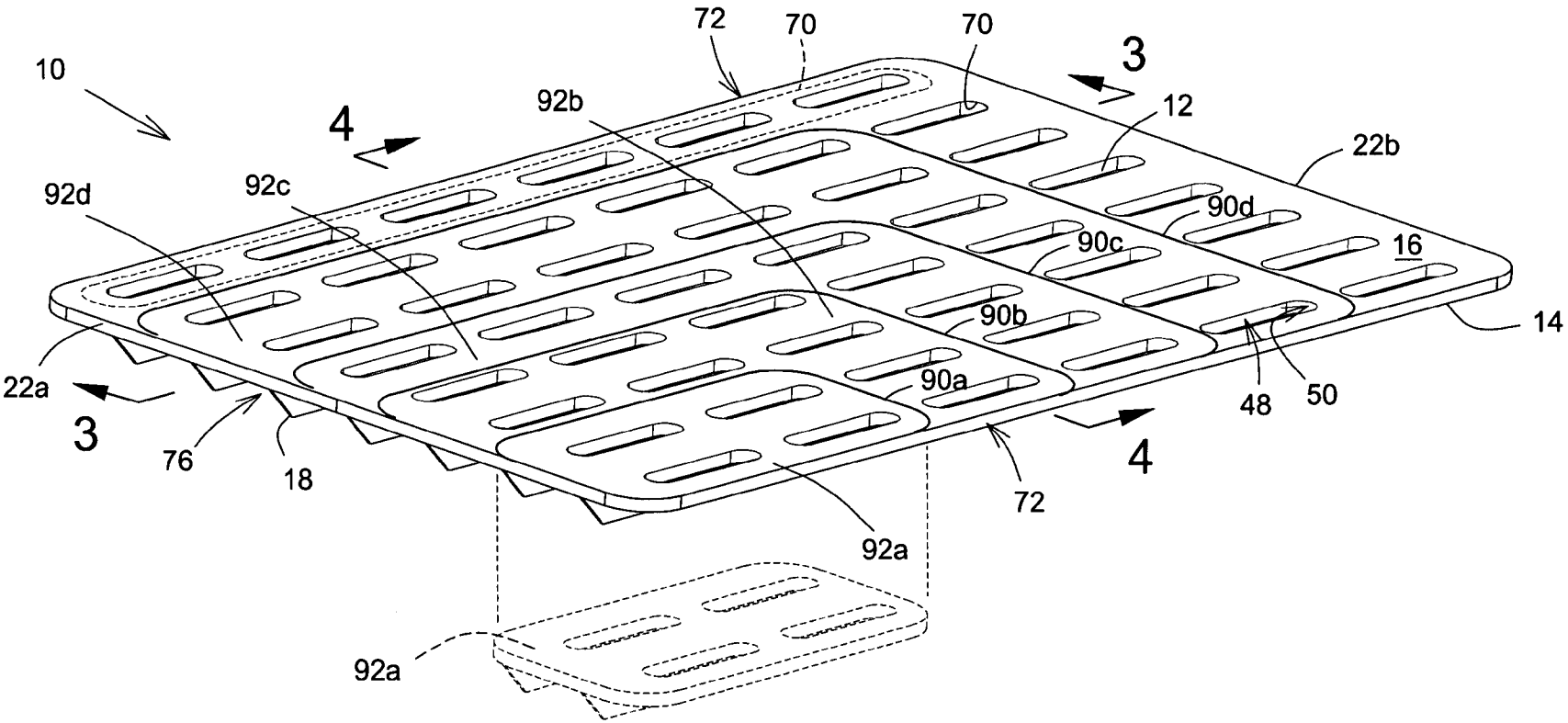
FIG. 1 is a perspective view of an insert for a cooler in accordance with an embodiment of the present invention.
Figure 1A:
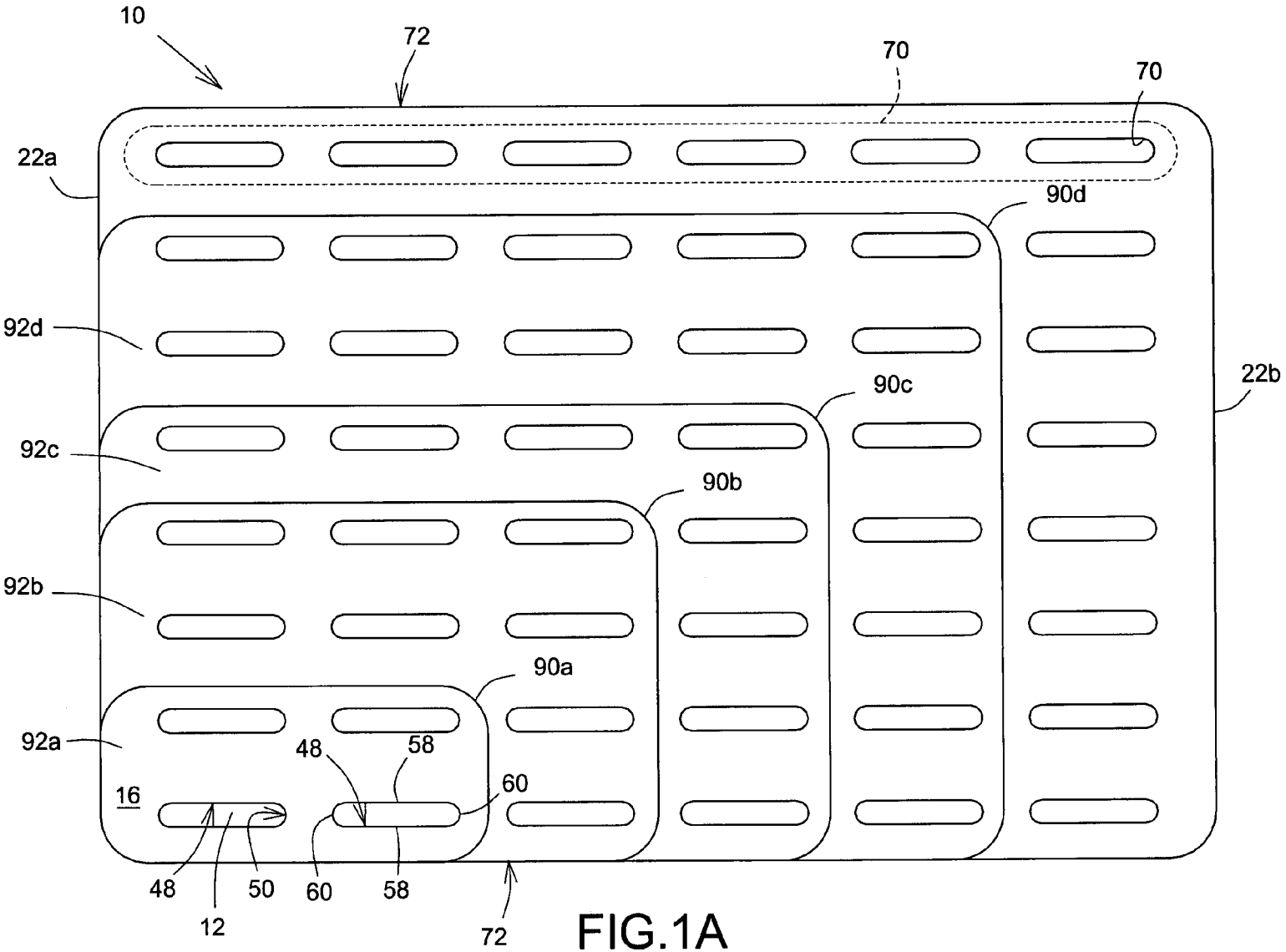
FIG. 1A is a top view of a portion of the insert shown in FIG. 1, showing draining apertures thereof.

Referring now to FIGS. 1 and 1A, insert, shown generally as 10, has draining apertures 12 which extend from a first, bottom surface 14 to a second, top surface 16 generally opposed thereto, and through which liquid may pass. Legs 18 for supporting insert 10 extend downwardly from first surface 14 and extend longitudinally between generally opposed first and second insert ends 22 of insert 10.

Figure 2:
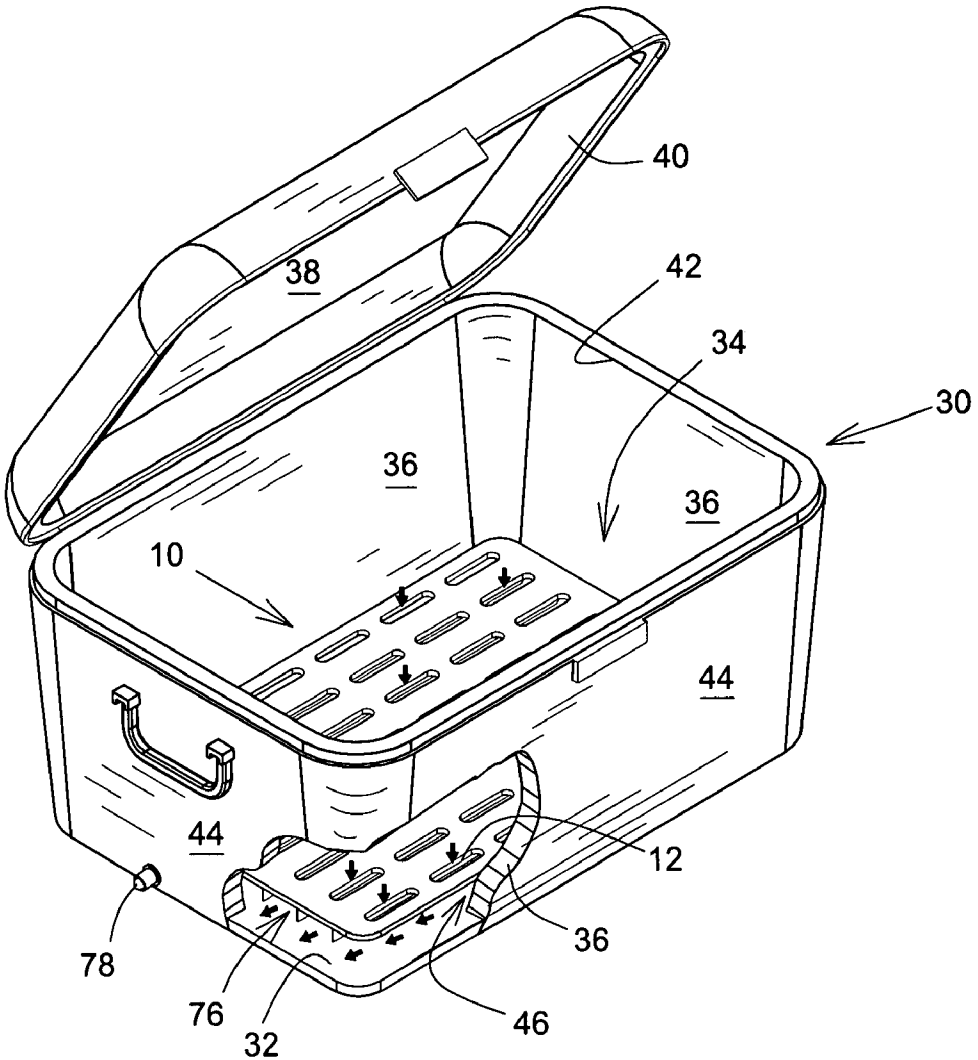
FIG. 2 is a perspective view of a cooler, with partial cross section, having the insert shown in FIG. 1 placed therein.

Reference is now made to FIG. 2, a perspective view of insert 10 placed in a cooler, shown generally as 30, for cooling and maintaining foodstuffs, not shown, placed therein in a cool state. Insert 10 is placed on lower surface 32 of interior 34 of cooler 30 and rests on lower surface 32 supported by legs 18. Lower surface 32 is bound and defined by cooler walls 36 which extend upwardly therefrom towards an upper surface 38 generally opposed to lower surface 32 and which may be part of a removable or releasable cover 40 which, when removed or released, exposes an opening 42 through which insert 10, foodstuffs, and coolant can be placed within interior 34 of cooler 30. Opening 42 and cover 40 may, alternatively, be situated on side surface 44 of cooler 30, with the opening 42 extending into cooler wall 36 to interior 34, provided opening 42 so situated is large enough to allow placement of insert 10, foodstuffs, and coolant therein.

Figure 3:
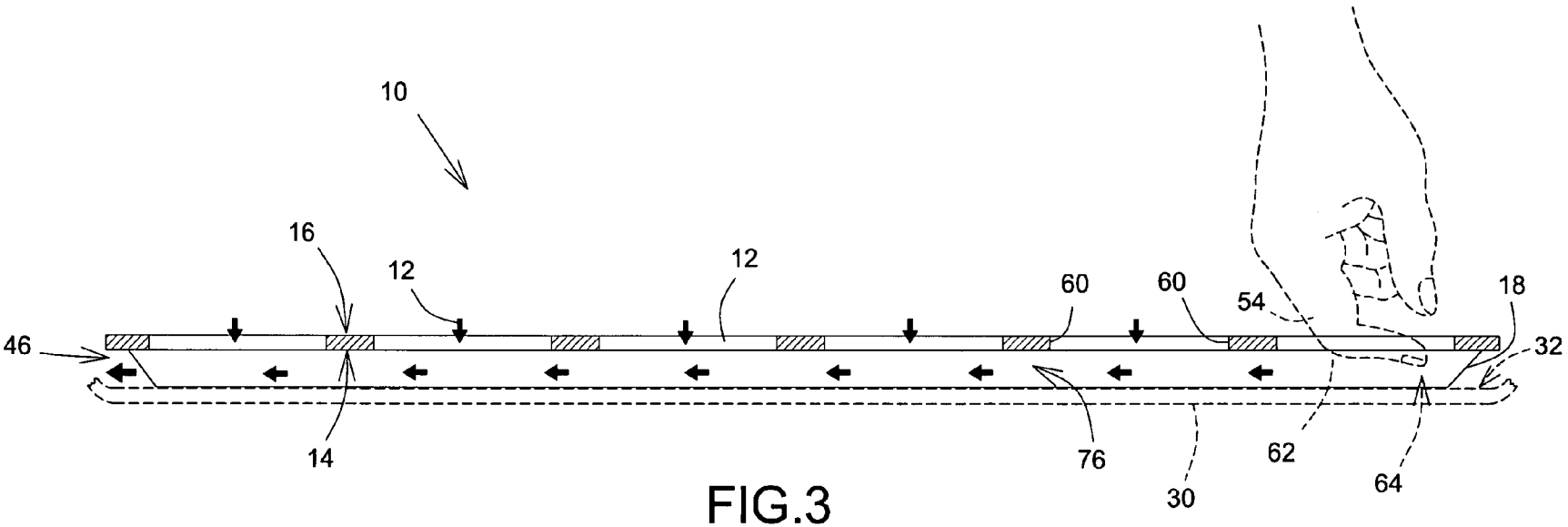
FIG. 3 is a cross sectional view of the insert shown in FIG. 1, taken along line 3-3 of FIG. 1.
Figure 4:
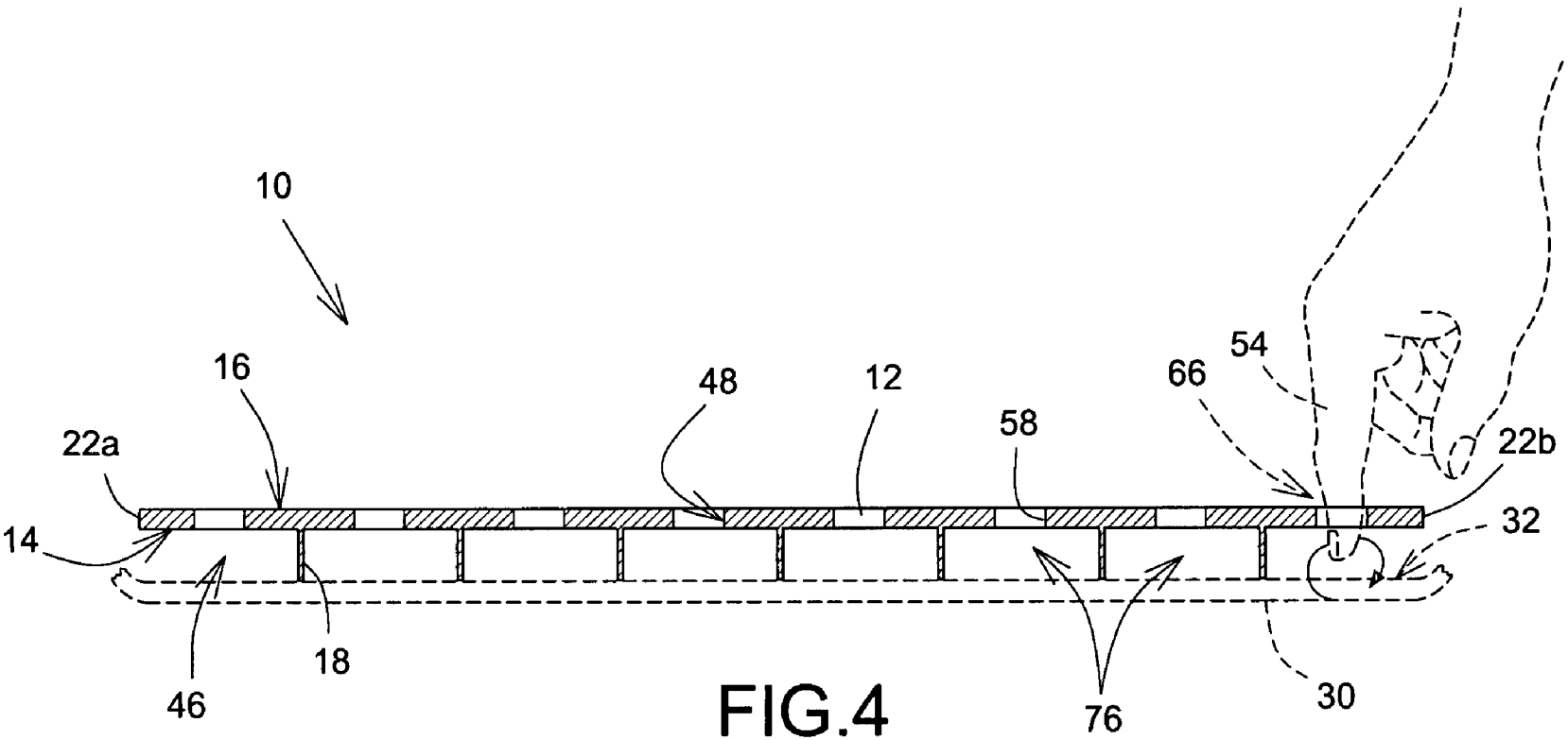
FIG. 4 is a cross sectional view of the insert shown in FIG. 1, taken along line 4-4 of FIG. 1.

Referring now to FIG. 2 in conjunction with FIG. 3 and FIG. 4, when insert 10 is placed in cooler 30, first surface 14 is separated from lower surface 32 by legs 18, thereby creating a space 46 therebetween. Foodstuffs are typically placed upon second surface 16 of insert 10 along with coolant, although coolant may, optionally, be placed in space 46, provided legs 18 are of sufficient height that space 46 is large enough to house coolant. Coolant is typically a frozen liquid, such as water frozen into ice, but may consist of other materials or substances typically used for cooling. Coolant absorbs heat from foodstuffs to cool them and maintain them in a cool state. Thus, when coolant is a frozen liquid, coolant will eventually liquefy, i.e. melt, back into a non-frozen liquid, resulting in the presence of liquid in proximity of the foodstuffs. In addition, cooling of foodstuffs with coolant may cause condensation of additional liquid, such as water, from air in proximity of the foodstuffs. Also, liquid may be released in proximity to the foodstuffs in cooler 30 by spillage of liquid foodstuffs therein. Since the foodstuffs are placed upon, i.e. on top, of second surface 16 of insert 10, provided that cooler 30 is maintained in an upright position in which foodstuffs are situated above space 46, liquids in proximity to foodstuffs drain through draining apertures 12 into space 46. Thus, insert 10 separates foodstuffs from liquids which, if left in proximity thereto, may have undesirable effects on foodstuffs.

Referring again to FIGS. 1 and 1A, each draining aperture 12 is defined by at least one elongate internal wall 48 having at least one curved section 50. Thus, sharp corners in which dirt may be accumulated and which are difficult to clean are avoided, thus facilitating cleaning of the internal wall 48, especially when such cleaning is undertaken manually.

Referring to FIGS. 1, 1A, 3 and 4, draining aperture 12 is sized and adapted such that a human finger 54, shown in FIGS. 3 and 4, may be easily inserted therein for scrubbing internal wall 48, which further facilitates manual cleaning thereof. Specifically, as best shown for the embodiment in FIG. 1A, internal wall 48 comprises of two elongate internal wall sections 58 of substantially equal length joined to each other by curved sections 50. Draining aperture 12 defined thereby is substantially rectilinear having generally opposed longitudinal curved ends 60 formed by curved sections 50. Draining aperture 12 is sized such that human finger 54 can be easily inserted into draining aperture 12 in a partially bent position, shown generally as 64 in FIG. 3, where a portion of human finger 54 extends longitudinally between internal wall sections 58. By flexing finger 54, on at least one joint 62 thereof, between bent position 64 and unbent position, shown generally as 66 in FIG. 4, in which finger 54 is substantially unbent, i.e. straight, finger 54 can engage internal wall sections 58 for scrubbing thereof during manual cleaning of internal wall 48. At the same time, curved ends 60 avoid buildup of dirt often associated with sharp internal corners and are also easily scrubbed by finger 54 for manual cleaning of internal wall 48. A cleaning instrument, such as a cloth, not shown, optionally engaged on human finger 54, may also be inserted into the draining aperture 12 for cleaning of internal wall 48. Alternatively, a cleaning instrument, such as a brush or the like, not shown, having approximately the same or smaller dimensions than a human finger 54 may be inserted into draining aperture 12 for manual cleaning of internal wall 48.

Finger 54 may also be inserted into draining aperture 12 such that a portion of finger 54 extends through draining aperture 12 and engages first surface 14 in proximity to draining aperture 12. A force directed way from lower surface 32 may then be exerted on insert 10 using finger 54 for easy removal of insert from cooler 30. Thus, draining apertures 12 size and shape also provide easy removal of insert 10.

The inventor has discovered that providing draining apertures 12 having approximately three inches between curved ends 60 and a spacing of approximately 0.75 inches between internal wall sections 58 allows for engagement of finger 64 therein as described above. Advantageously, these dimensions, i.e. sizes, are also smaller than many foodstuffs. Thus, draining apertures 12 so sized should impede many foodstuffs from passing therethrough into space 46. Draining aperture 12 therefore provides facilitated cleaning and removal of insert 10, as described above, while still allowing drainage of liquid into space 46 and separation of liquid from most foodstuffs in cooler 30. It should be noted however, that other combinations of sizes and shapes for draining apertures 12 are possible provided that they provide sufficient space for insertion of finger 54 into draining aperture 12 while ensuring that finger 54, when inserted therein, is situated proximally to internal wall 48 and that draining aperture 12 is small enough that most foodstuffs cannot pass therethrough. It is not the intention of the inventor to limit the scope of the invention to any specific shape or any specific dimensions enumerated herein. Also, while the embodiment shown for insert 10 has a plurality of draining apertures 12 and internal walls 48 therefor, the invention may also be implemented with insert 10 having, when inserted into cooler 30, as little as one draining aperture 12 and corresponding internal walls 48 for draining liquid into space 46.

Referring again to FIG. 1 in conjunction with FIG. 4, draining apertures 12 in the embodiment shown are in substantially parallel alignment with each other and form rows 70 extending from first insert end 22*a* to second insert end 22*b* of insert. Rows 70, in turn, are in substantially parallel alignment with each other. Rows 70 each have at least one leg 18 situated between them and which extend from first insert end 22*a* to second insert end 22*b* in substantially parallel alignment with rows 70. In other words, each row 70 is adjacent to an adjacent row 70 and at least one leg 18 is situated therebetween, with rows 70 and leg 18 being in substantially parallel alignment with each other. The positioning of legs 18 between adjacent rows 70 advantageously provides support for the entire width of insert between insert sides 72 and entire length of insert between insert ends 22, thus ensuring that insert 10 can adequately support foodstuffs and coolant placed thereupon to separate them from liquid in space 46.

Optionally, as shown in FIGS. 2, 3, and 4, legs 18 may be sized such that they extend integrally to lower surface 32 throughout the entire length of leg 18 between insert ends 22. In other words, leg 18 is sized and adapted such that leg 18 is in contact with lower surface 18 for the entire length of leg 18 extending between insert ends 22, such that channels 76 are formed in space 46 between legs 18 and between legs and cooler walls 36 of cooler 30. Liquid that drains into space 46 through draining apertures 12 in a row 70 thus drains into corresponding channel 76 situated directly below. Flow of liquid in space 46, shown by bold arrows in FIGS. 2 and 3, is then directed through channels 76. Channels 76 are particularly advantageous when cooler 30 has an optional drain valve 78 that extends from exterior of the cooler 30 through the cooler wall 36 into the interior 34 for draining liquid therefrom. In particular, when valve 78 is situated on a side surface 44 opposite a cooler wall 44, or part thereof, with which at least one of first and second insert ends 22*a,b* is in substantially parallel alignment, then channel 76 will usefully direct and facilitate flow of liquid therein towards drain valve 78 when cooler 30 is tilted theretoward.

The inventor has discovered that legs 18 extending for approximately five eighths of an inch below first surface 14, i.e. height of space 46 is five eighths of an inch, are generally sufficient to render space 46 of sufficient size, i.e. volume, to hold enough liquid to maintain liquid separate from foodstuffs for most typical uses of cooler 30. It should be noted, however, that the distance from which legs 18 extend below first surface 14 can be increased or decreased to, respectively increase or decrease volume for storage of liquid in space 46. In addition, while the distance from which legs 18 extend below first surface 14 should, ideally, be high enough that optional drain valve 78 is situated below first surface 14, this need not necessarily be the case since liquid, when drained through drain valve 78, will pass quickly therethrough, thus minimizing the duration of any exposure of the foodstuffs to liquid. It is not the intention of the inventor to limit the scope of the invention to the size of space 46 or the distance from which legs 18 extend below first surface 14 to any specific dimensions described herein.

As best shown in FIG. 1, insert 10 may have optional guide lines 90 marked on at least one of first surface 14 and second surface 16 thereof. A wide variety of dimensions and shapes, defined by cooler wall 36, are possible for lower surface 32 of interior 34 of cooler 30. In other words, cooler 30 may be one of a number of coolers having different dimensions, i.e. size, and shape for lower surface 32. The shape of insert 10 is substantially similar in shape to that of lower surface 32. Each guide line 90, in turn, traces a portion 92 of insert 10. Portion 92 is smaller in size than insert 10 but substantially similar in shape thereto and includes other, usually smaller, portions 92 situated inwardly with regard to, i.e. bounded by, portion 92. Accordingly, a user can easily adapt size of insert 10 for use with any cooler 30 of which lower surface 32 is substantially similar in shape to insert 10 by cutting insert 10 along guide lines 90 which define the innermost portion 92 that most closely approximates, without surpassing, the size of lower surface 32 and subsequently separating the innermost portion 92 from the remainder of insert 10 to reduce size of insert 10 to that of innermost portion 92. For example, if lower surface 32 was larger than portion 92*a* but smaller than portion 92*b*, user would cut insert 10 along line guide line 90, i.e. the smallest, innermost portion, and separate 92*a* from the remainder of insert 10. Insert 10 would then still have shape similar to that of lower surface 32 but the size of insert 10 is reduced to that of portion 92*a*, thus allowing insert 10 to fit when placed on lower surface 32 of cooler 30. In addition, insert 10 may be cut for use with a first cooler 30 and then cut again for use with a smaller cooler 30 having a lower surface 32 smaller than that of first cooler 30, should the user wish to use the insert 10 with smaller cooler 30. For example, suppose user had initially cut insert 10 along line 90*c*, which defines portion 92*c* and also includes inwardly situated portions 92*a* and 92*b*, for use with first cooler 30, but subsequently purchased a smaller cooler 30 having a lower surface 32 smaller than portion 92*c* but larger than portion 92*b*, with portion 92*b* also including portion 92*a*. In such case, user could cut insert 10 along guide line 90*b* to adapt insert 10 for use with smaller cooler 30. Thus, guide lines 90 approximate the size and shape of the lower surface 32 and facilitate cutting of insert 10 by a user along guide lines 90 to substantially match lower surface 32 of cooler 30 in shape and size.

While the cooler lower surface 32 and insert 10 shown are substantially rectangular, it should be noted that other shapes are possible for lower surface 32 and insert 10. Generally, insert 10 will have the same overall shape as that of lower surface 32. Guide lines 90 will define increasingly inwardly situated portions 92 of insert 10 of the same shape, but of smaller size, which user will cut to adapt size of insert 10 to lower surface 32. For example, lower surface 32 and insert 10 could be circular, ovular or triangular in shape, with guide lines 90 defining portions 92 of similar circular, ovular or triangular shape on insert 10 but of smaller size. In particular, for inserts 10 of circular shape, the guide lines 90 could be marked as concentric circles on insert 10 to define portions 92. For oval or triangular shaped inserts 10, guide lines 90 could mark a series of, respectively, oval portions 92 or triangular portions 92 of increasing dimension surrounding, respectively, an innermost, smallest oval portion 92 or innermost smallest triangular portion 92. It will be apparent to one skilled in the art that other shapes for insert 10 may also be possible, depending on shapes of lower surface 32. It is not the intention of the inventor to the scope of the invention to inserts 10 having the shapes described herein.

It should be noted that the various possible sizes for lower surface 32 having a given shape are often standardized for facilitating production of cooler 30. Accordingly, guide lines 90 may be marked on insert 10 to, optionally, approximate these standardized sizes. The insert 10 shown, before cutting and removal of portions 92, is approximately 12 inches in width along insert ends 22 and 8 inches in length along insert sides 72, and guide lines 90 define portions 92 of substantially proportional, yet smaller size, which reflect standardized sizes for coolers 30 having lower surfaces 32 of rectangular shape. However, one skilled in the art will readily realize that other sizes, standardized or otherwise, are possible for insert 10 and portions 92 thereof and that sizes of insert 10 and portions 92 thereof defined by guide lines 90 may be modified for adaptation to different shapes for lower surface 32.

Insert 10 is typically made of sturdy, yet easily cut with cutting instrument, impermeable material, such as a sturdy plastic or the like, so as to be able to support foodstuffs thereupon while separating them from liquid. Cutting instrument used to cut along guide lines 90 may be a knife, scissors, or any other cutting instrument capable of cutting material of insert 10 along relatively fine lines.

Although insert 10 of the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. An insert for placement on a lower surface of an interior of a cooler for maintaining foodstuffs therein in a cool state, the lower surface being bounded by at least one cooler wall extending therefrom, said insert comprising:

a first surface having at least one leg extending vertically therefrom for supporting said insert upon the lower surface and defining a space therebetween;

a second surface, generally opposed to said first surface and upon which the foodstuffs rest when placed in the cooler; and at least one elongated curved draining aperture extending through said insert for drainage of liquid in the cooler away from the foodstuffs and into said space, each said draining aperture being defined by at least one elongate internal wall having at least one curved section, said draining aperture defined thereby being sized and adapted for cleaning of said wall by insertion therein of a human finger and scrubbing said wall therewith, said curved section facilitating said scrubbing and thereby said cleaning; and at least one guide line disposed on at least one of said first and second surface, said guide line approximately representing a surface size and a surface shape of the lower surface for facilitating cutting of said insert by a user to substantially approximatey said surface size and said surface shape for adapting said insert for placement upon said lower surface.

2. The insert of claim 1 wherein said at least one elongate internal wall comprises two elongate internal wall sections of substantially equal length and two said curved sections, said internal wall sections being joined to each other by said curved sections, said draining aperture defined thereby being substantially rectilinear and having curved ends formed by said curved sections.

3. The insert of claim 2 wherein said two elongate internal wall sections are in substantially parallel alignment with each other.

4. The insert of claim 2 wherein said draining aperture is sized and adapted such that said human finger is insertable therein in a partially bent position in which at least a part of said human finger extends longitudinally between said internal wall sections.

5. The insert of claim 1 wherein said at least one leg extends longitudinally between a first insert end and a generally opposed second insert end of said insert.

6. The insert of claim 1 wherein said insert is sized to cover substantially all of said lower surface.

7. The insert of claim 1 said insert being removable from the cooler.

8. The insert of claim 1 wherein said at least one draining aperture comprises a plurality of draining apertures.

9. The insert of claim 8 wherein said draining apertures are substantially aligned with each other in at least one row thereof extending between a first insert end and a generally opposed second insert end of said insert.

10. The insert of claim 9 wherein said at least one leg extends longitudinally between said first insert end and said second insert end in substantially parallel alignment with said at least one row, said leg being situated proximally thereto.

11. The insert of claim 9 wherein said at least one row constitutes a plurality of rows in substantially parallel alignment with each other.

12. The insert of claim 11 wherein said at least one leg comprises a plurality of legs, each said leg being situated between two adjacent said rows and extending longitudinally between said first insert end and said second insert end in substantially parallel alignment said two adjacent said rows.

13. The insert of claim 12 wherein said legs extend integrally to said lower surface and form channels through which said liquid drained through said draining apertures may flow to a drain valve situated proximately to said lower surface and extending from a side surface of cooler through the cooler wall, or a part thereof generally opposite thereto and with which said insert ends are in substantially parallel alignment, said channels thereby facilitating flow of said liquid towards the cooler wall, or the part thereof, opposite said drain valve and drainage of said liquid therethrough.

* * * * *